US008966689B2

(12) United States Patent
McGuire et al.

(10) Patent No.: US 8,966,689 B2
(45) Date of Patent: Mar. 3, 2015

(54) MULTI-ZONE FLUID CHAMBER AND MATTRESS SYSTEM

(71) Applicant: Select Comfort Corporation, Minneapolis, MN (US)

(72) Inventors: John McGuire, New Hope, MN (US); Saurabh Chhaparwal, Minneapolis, MN (US); Wade Daniel Palashewski, Andover, MN (US); Kody Karschnik, Maple Grove, MN (US)

(73) Assignee: Select Comfort Corporation

( * ) Notice: Subject to any disclaimer, the term of this patent is extended or adjusted under 35 U.S.C. 154(b) by 0 days.

(21) Appl. No.: 13/828,985

(22) Filed: Mar. 14, 2013

(65) Prior Publication Data

US 2014/0137332 A1 May 22, 2014

Related U.S. Application Data

(60) Provisional application No. 61/728,094, filed on Nov. 19, 2012.

(51) Int. Cl.
*A47C 27/10* (2006.01)
*A47C 27/08* (2006.01)

(52) U.S. Cl.
CPC ..... *A47C 27/081* (2013.01); *A47C 27/10* (2013.01)
USPC ..... 5/710; 5/654; 5/655.3; 5/706; 5/713; 5/724

(58) Field of Classification Search
CPC .... A47C 27/10; A47C 27/082; A47C 27/084; A47C 27/088; A47C 27/18; A47C 27/001; A47C 27/081; A47C 27/146; A47C 17/045; A47C 20/041; A61G 7/05769; A61G 7/05776; A61G 7/015
USPC ..... 5/652.1, 655.3, 690, 706, 707, 710, 5/713, 714, 724, 654, 711, 712, 715; 441/40, 129; 297/452.41
See application file for complete search history.

(56) References Cited

U.S. PATENT DOCUMENTS

| | | | | | |
|---|---|---|---|---|---|
| 2,247,667 | A | * | 7/1941 | Rosberger | 5/723 |
| 2,850,252 | A | * | 9/1958 | Ford | 244/114 R |
| 3,319,273 | A | * | 5/1967 | Solin | 5/420 |
| 3,428,974 | A | * | 2/1969 | Stuart | 5/710 |
| 4,442,556 | A | * | 4/1984 | Craigie | 5/13 |
| 5,062,169 | A | * | 11/1991 | Kennedy et al. | 5/713 |
| 5,086,529 | A | * | 2/1992 | DeGroot | 5/710 |
| 5,249,318 | A | * | 10/1993 | Loadsman | 5/710 |
| 5,487,196 | A | * | 1/1996 | Wilkinson et al. | 5/715 |
| 5,491,854 | A | * | 2/1996 | Music | 5/618 |

(Continued)

*Primary Examiner* — Nicholas Polito
*Assistant Examiner* — David R Hare
(74) *Attorney, Agent, or Firm* — Fish & Richardson P.C.

(57) ABSTRACT

A support surface assembly comprises a support surface and a multi-zone chamber comprising two or more inflatable bladders forming the support surface. In an example, first and second bladders of the multi-zone chamber are arranged in a head to toe configuration and are substantially free to move with respect to one another. In another example, a flexible joint is included between first and second bladders, the flexible joint including one or more releasable fasteners. In another example, a fluid communication conduit between first and second bladders couples the first and second bladders in a series fluid communication. In another example, the bladders form an array of bladders arranged in series from a head to a foot of the support surface, wherein each of the bladders has substantially the same dimensions.

24 Claims, 13 Drawing Sheets

(56) References Cited

U.S. PATENT DOCUMENTS

| | | | | | |
|---|---|---|---|---|---|
| 6,038,722 | A * | 3/2000 | Giori et al. | 5/709 |
| 6,108,843 | A * | 8/2000 | Suzuki et al. | 5/713 |
| 6,115,861 | A * | 9/2000 | Reeder et al. | 5/727 |
| 6,148,461 | A * | 11/2000 | Cook et al. | 5/713 |
| 6,253,401 | B1 * | 7/2001 | Boyd | 5/713 |
| 6,269,505 | B1 * | 8/2001 | Wilkinson | 5/713 |
| 6,813,790 | B2 * | 11/2004 | Flick et al. | 5/713 |
| 6,922,863 | B2 * | 8/2005 | Giori et al. | 5/709 |
| 7,219,380 | B2 * | 5/2007 | Beck et al. | 5/713 |
| 7,360,266 | B2 * | 4/2008 | Kasatshko | 5/722 |
| 7,865,988 | B2 * | 1/2011 | Koughan et al. | 5/691 |
| 8,146,187 | B2 * | 4/2012 | Lachenbruch et al. | 5/612 |
| 2004/0158927 | A1 * | 8/2004 | Soltani et al. | 5/689 |
| 2006/0123548 | A1 * | 6/2006 | Heath | 5/644 |
| 2008/0262657 | A1 * | 10/2008 | Howell et al. | 700/275 |

* cited by examiner

MULTI-ZONE FLUID CHAMBER AND MATTRESS SYSTEM

CROSS-REFERENCE TO RELATED APPLICATION

The subject matter of this application is related to McGuire et al., U.S. Provisional Patent Application Ser. No. 61/728,094, entitled "MULTI-ZONE AIR CHAMBER AND MATTRESS SYSTEM," filed on Nov. 19, 2012, which is incorporated by reference herein in its entirety.

BACKGROUND

Beds comprising mattresses formed from fluid-inflatable bladders, such as air-inflatable bladders, can allow a user to adjust the pressure in the bladders, which can adjust the perceived firmness of the mattress for the user to a level of individual comfort. In beds designed for two users, such as queen-sized or king-sized beds, each side of the bed can be provided with its own inflatable bladder or set of inflatable bladders and controls to allow each user to separately adjust their own side of the bed to their preferred individual comfort level.

Beds can also be designed to be movable or adjustable to positions other than a traditional flat, horizontal support surface. For example, the bed can include one or more articulable sections that can be raised and lowered, for example to adjust a position of the user's head and upper torso or to adjust a position of the user's legs, or both. Adjustable beds with fluid-inflatable mattresses can provide challenges in maintaining a user's preferred firmness level due to the interaction between the user and the inflatable bladders or between the inflatable bladders and the articulable sections, or both.

SUMMARY

The present disclosure is directed to a sleep system, and in particular a support surface assembly that can be used as part of a sleep system. The sleep system can allow users to select one or more positions of the bed by controlling adjustment of one or more articulable sections of the bed. The support surface assembly can comprise one or more configurations of a set of inflatable bladders that is configured to improve consistency and performance of the inflatable mattress during articulation of the one or more articulable sections, or during a user position change (e.g., the user changing position during sleep), or both.

The present disclosure describes a support surface assembly comprising a support surface and a multi-zone chamber including a first inflatable bladder and a second inflatable bladder, the first and second bladders forming the support surface, wherein the first bladder and the second bladder are substantially free to move with respect to one another.

The present disclosure also describes a support surface assembly comprising a support surface, a multi-zone chamber including a first inflatable bladder and a second inflatable bladder, the first and second bladders forming the support surface, and a flexible joint between the first inflatable bladder and the second inflatable bladder, the flexible joint comprises one or more releasable fasteners connecting the first fluid bladder and the second fluid bladder.

The present disclosure further describes a support surface assembly comprising a support surface, a multi-zone chamber including a first inflatable bladder and a second inflatable bladder, the first and second bladders forming the support surface, a fluid inlet tube connected to the first inflatable bladder, and a fluid communication conduit between the first and second inflatable bladders coupling the first and second inflatable bladders in series fluid communication.

The present disclosure also describes a support surface assembly comprising a support surface and a multi-zone chamber including an array of a plurality of inflatable bladders arranged in series from a head to a foot of the support surface, wherein the plurality of inflatable bladders form the support surface, and wherein each of the plurality of inflatable bladders has substantially the same dimensions.

These and other examples and features of the present systems and methods will be set forth in part in the following Detailed Description. This Summary is intended to provide an overview of the present subject matter, and is not intended to provide an exclusive or exhaustive explanation. The Detailed Description below is included to provide further information about the present systems and methods.

These and other examples and features of the present systems and methods will be set forth in part in the following Detailed Description. This Summary is intended to provide an overview of the present subject matter, and is not intended to provide an exclusive or exhaustive explanation. The Detailed Description below is included to provide further information about the present systems and methods.

DETAILED DESCRIPTION

This disclosure describes a sleep system including an adjustable bed. This disclosure also describes a support surface assembly that can be used in an adjustable bed. The support surface assembly can comprise one or more configurations of a set of inflatable bladders configured to improve consistency and performance of the inflatable mattress during articulation of the one or more articulable sections, or during a user position change (e.g., the user changing position during sleep), or both. For example, the inflatable bladder configuration can minimize a change in pressure within the inflatable bladders, and thus a change in firmness experienced by the user, when an articulable section of the bed is moved from one position to another. The inflatable bladder configuration can also avoid other inconsistencies, such as sagging of an inflatable bladder or involuntary shifting of a user to a side of their respective sleep area (sometimes referred to as "roll to the middle") when the mattress is at a low pressure.

Figure 1:
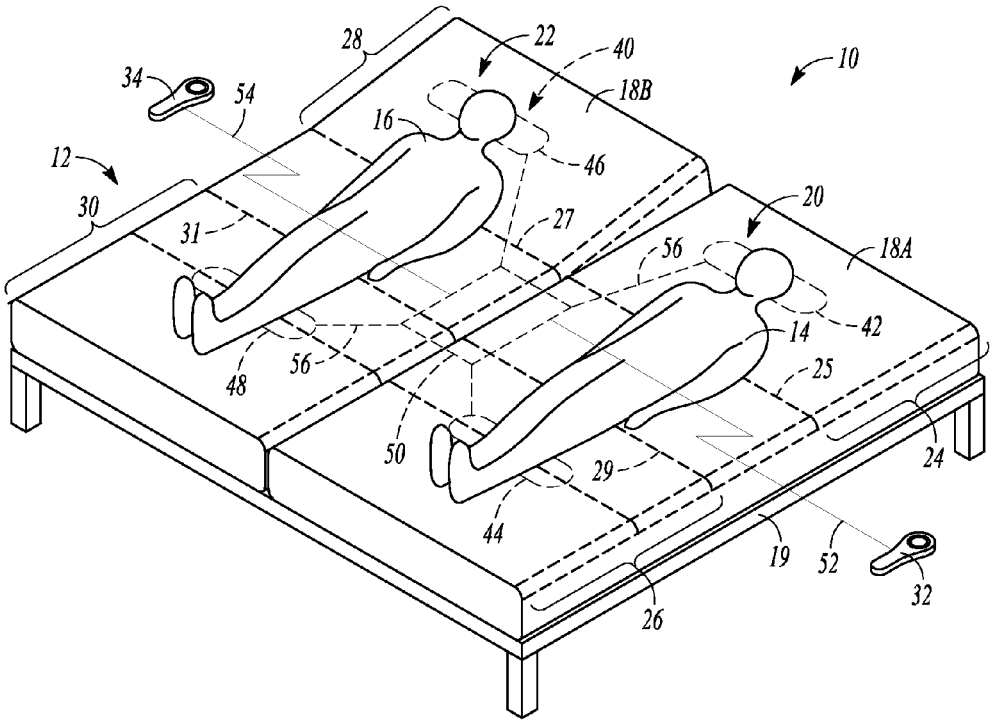
FIG. 1 is a perspective view of an example sleep system including an adjustable bed for two occupants.

FIG. 1 shows a perspective view of an example sleep system 10. The sleep system 10 can include a bed 12 that is configured and intended to be used by one or more occupants. In the example shown in FIG. 1, the bed 12 is designed to be used be two occupants, a first occupant 14 and a second occupant 16. In such a configuration, the bed 12 can include one or more mattresses 18A, 18B (collectively referred to as "mattress 18" or "mattresses 18") supported by a frame 19. The occupants 14, 16 can be supported by the one or more mattresses 18. The bed 12 can include a first sleep area 20 for the first occupant 14 and a second sleep area 22 for the second occupant 16. In the case of a bed designed for a single occupant, a single mattress can be used. The one or more mattresses 18 can comprise a pair of mattresses 18A, 18B, with a first mattress 18A making up the first sleep area 20 and a second mattress 18B making up the second sleep area 22.

Each of the sleep areas 20, 22 can be movable or articulable between a plurality of positions to provide the occupants 14, 16 with the ability to select a preferred position for comfort of for a particular purpose. Each sleep area 20, 22 can include one or more articulable sections. In an example, the first sleep area 20 can include a first head section 24 that can be raised and lowered to adjust a position of the head or upper torso, or both, of the first occupant 14 and a first leg section 26 that can be raised and lowered to adjust a position of the legs or lower torso, or both, of the first occupant 14. Similarly, the second sleep area 22 can include a second head section 28 that can be raised and lowered to adjust a position of the head or upper torso, or both, of the second occupant 16 and a second leg section 30 that can be raised and lowered to adjust a position of the legs or lower torso, or both, of the second occupant 16.

Each articulable section 24, 26, 28, 30 can include a joint at one end that allows for pivoting movement of the articulable section 24, 26, 28, 30 relative to other portions of the bed 12. For example, the first head section 24 can include a pivoting joint 25 that allows for pivoting articulation of the first head section 24. Similarly, the first leg section 26 can include a pivoting joint 27, the second head section 28 can include a pivoting joint 29, and the second leg section 30 can include a pivoting joint 31.

As shown in the example of FIG. 1, the first sleep area 20 is in a first configuration while the second sleep area 22 is in a second configuration. For example, as shown in FIG. 1, the first sleep area 20 is in a flat configuration with the first head section 24 and the first leg section 26 being in a horizontal or substantially horizontal orientation, and the second sleep area 22 includes at least one articulable section 28, 30 in an articulated position relative to the other section. The example configuration of the second sleep area 22 in FIG. 1 includes the second head section 28 being elevated relative to the horizontal position.

The sleep system 10 can also include a pair of user controlling devices 32, 34 to allow each occupant 14, 16 to control the articulation of his or her respective sleep area 20, 22. As shown in FIG. 1, the sleep system 10 can include a first user controlling device 32, e.g., a first handheld remote control 32, that has been programmed to control operation of the first sleep area 20, and a second user control device 34, e.g., a second handheld remote control 34, that has been programmed to control operation of the second sleep area 22. The first occupant 14 can use the first remote control 32 to control operation of the first sleep area 20, upon which the first occupant 14 is sleeping, and the second occupant 16 can use the second remote control 34 to control operation of the second sleep area 22 upon which the second occupant 16 is sleeping.

The sleep system 10 can further include an articulation system 40 for controlling articulation of the articulable sections 24, 26, 28, 30. The articulation system 40 can include a set of articulating motors, with each articulable section being articulated by one or more of the motors. For example, a first head motor 42 can be configured to articulate the first head section 24 of the first sleep area 20. A first leg motor 44 can be configured to articulate the first leg section 26 of the first sleep area 20. A second head motor 46 can be configured to articulate the second head section 28 of the second sleep area 22. And, a second leg motor 48 can be configured to articulate the second leg section 30 of the second sleep area 22. Examples of motors that can be used for the articulating motors 42, 44, 46, 48 include, but are not limited to, bed articulating motors manufactured by Leggett & Platt, Inc., Carthage, Mo., USA.

The articulation system 40 can also include one or more controllers, such as a control box that includes the electronics and hardware for providing instructions to the articulating motors 42, 44, 46, 48. FIG. 1 shows the articulation system 40 including a single, common controller 50 that is configured to control each of the sleep areas 20, 22, e.g., each of the articulating motors 42, 44, 46, 48. The articulation system 40 can also include more than a single common controller. For example, each sleep area 20, 22 can have its own controller, such as a first controller corresponding to the first sleep area 20 and configured to control the articulating motors 42 and 44 and a second controller corresponding to the second sleep area 22 and configured to control the articulating motors 46 and 48.

Each remote control 32, 34 can be in communication with the one or more controllers 50, such as via a wireless communication link 52, 54. The remote controls 32, 34 can send movement control signals to the controller 50 via the communication links 52, 54. A "movement control signal," as used herein, can refer to a signal or plurality of signals sent from a remote control 32, 34 to the controller 50 corresponding to a particular movement or position of one or more of the articulable sections 24, 26, 28, 30. A movement control signal can include one or more instructions for the direction of movement of a particular articulable section 24, 26, 28, 30, e.g., the direction of movement of a corresponding articulating motor 42, 44, 46, 48, a speed for the movement of a particular articulable section 24, 26, 28, 30 or of a particular articulating motor 42, 44, 46, 48, or an overall position of the corresponding sleep area 20, 22 being controlled by the remote control 32, 34, such as a preset position.

The controller 50 can send one or more motor control signals to the articulating motors 42, 44, 46, 48 corresponding to a desired motion of the articulating motors 42, 44, 46, 48. A "motor control signal," as used herein, can refer to a signal or plurality of signals sent from a controller, such as the controller 50, to one or more articulating motors 42, 44, 46, 48 corresponding to a particular movement or position of one or more articulable sections 24, 26, 28, 30. A motor control signal or signals can comprise an instruction for one or both of the direction that the articulating motor 42, 44, 46, 48 should articulate and the speed that the articulating motor 42, 44, 46, 48 should travel. In an example, a plurality of communication cables 56 can carry the motor control signals from the controller 50 to the articulating motors 42, 44, 46, 48, e.g., with each cable 56 corresponding to a particular motor 42, 44, 46, 48.

Examples of adjustable beds that are similar to the articulable sleep areas described in the present disclosure include, but are not limited to, Sleep Number Split King or Split Queen beds, sold by Select Comfort Corp., Minneapolis, Minn., or the Queen Split, California King Split, or Eastern King Split mattresses sold by Comfortaire Corp., Greenville, S.C. Other sizes of split-type articulating mattress, other than queen and king size mattresses, can be used without varying from the scope of the present disclosure.

Although FIG. 1 is shown and described as including one or more articulable sleep areas, the present disclosure is not so limited, and the articulable sleep areas 20, 22 of FIG. 1 are merely meant to be a non-limited example. Rather, the sleep systems of the present disclosure can also include non-articulating, or standard type sleep areas.

Figure 2:
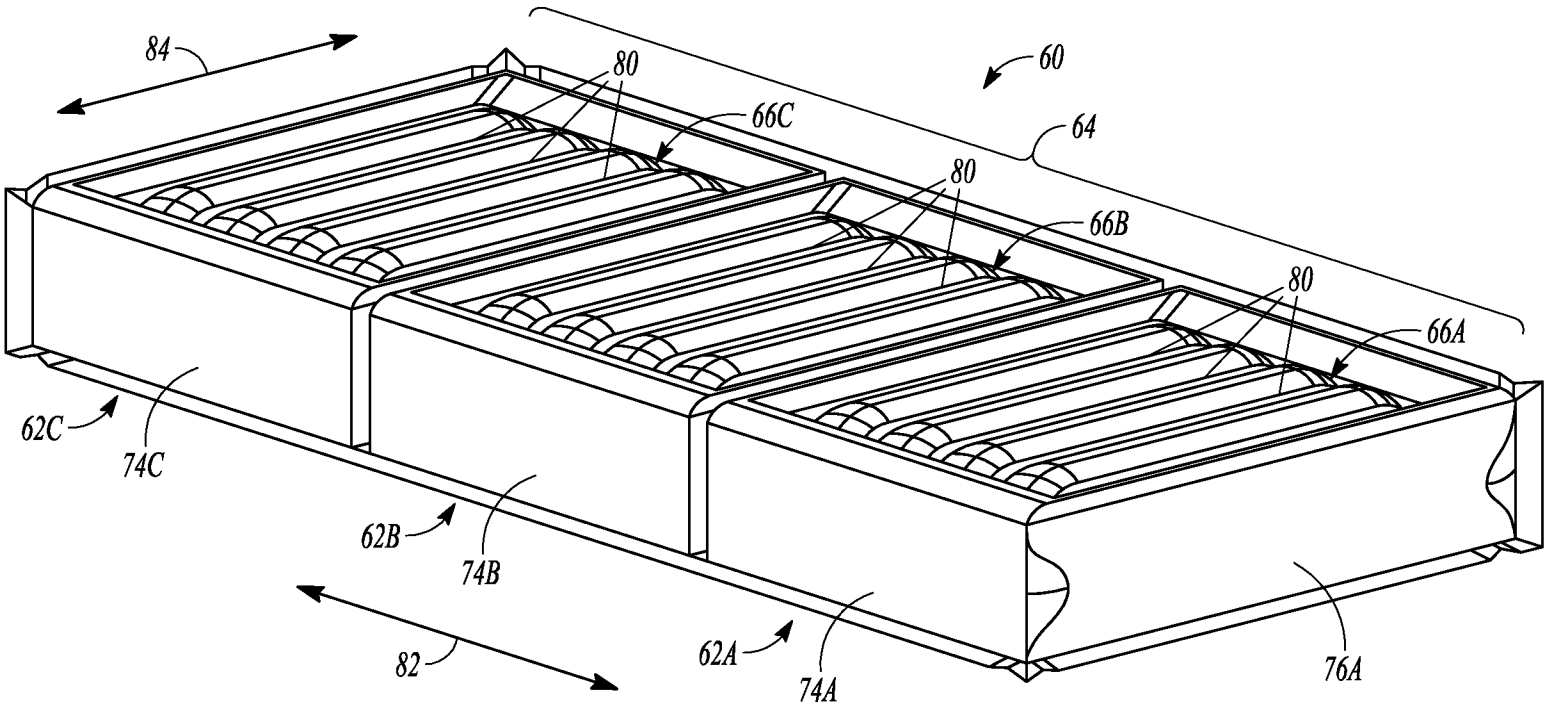
FIG. 2 is a perspective view of an example support surface assembly comprising a plurality of inflatable bladders that can be used in the example sleep system of FIG. 1.
Figure 3:
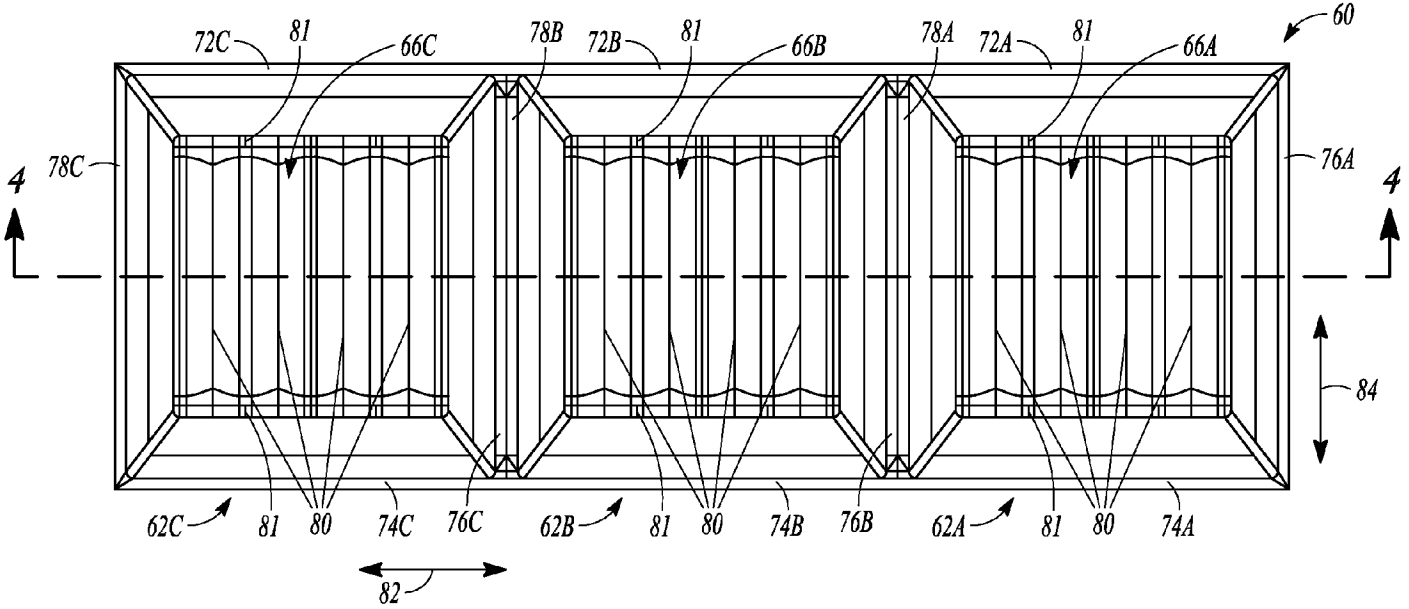
FIG. 3 is a top view of the example support surface assembly of FIG. 2.
Figure 4:
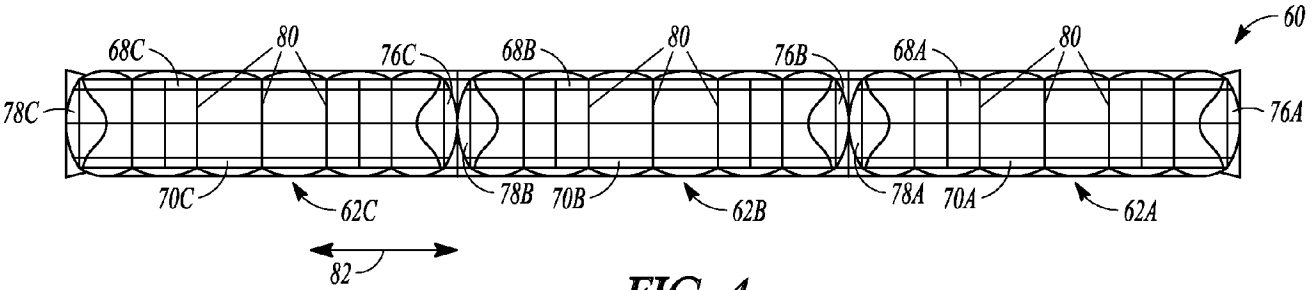
FIG. 4 is a cross-sectional side view taken along the line 4-4 in FIG. 3.
Figure 5:
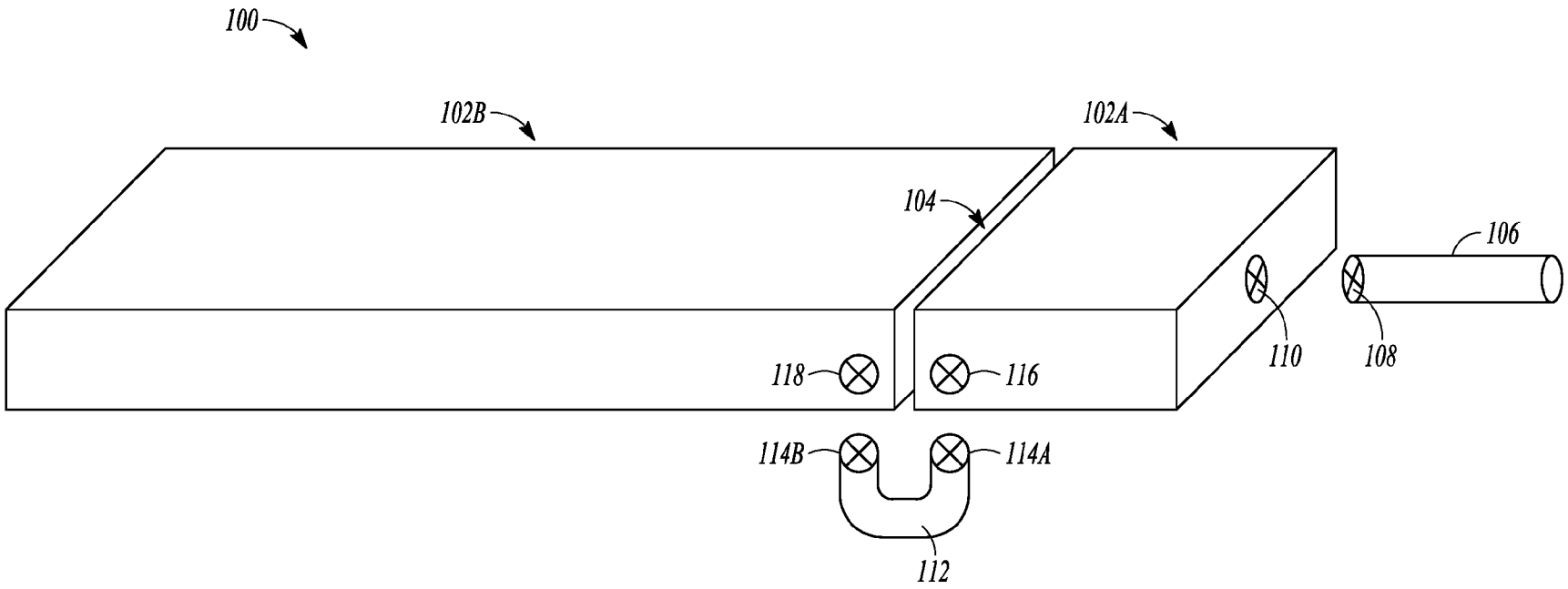
FIG. 5 is a conceptual perspective view of a first example of a support surface assembly.
Figure 6:
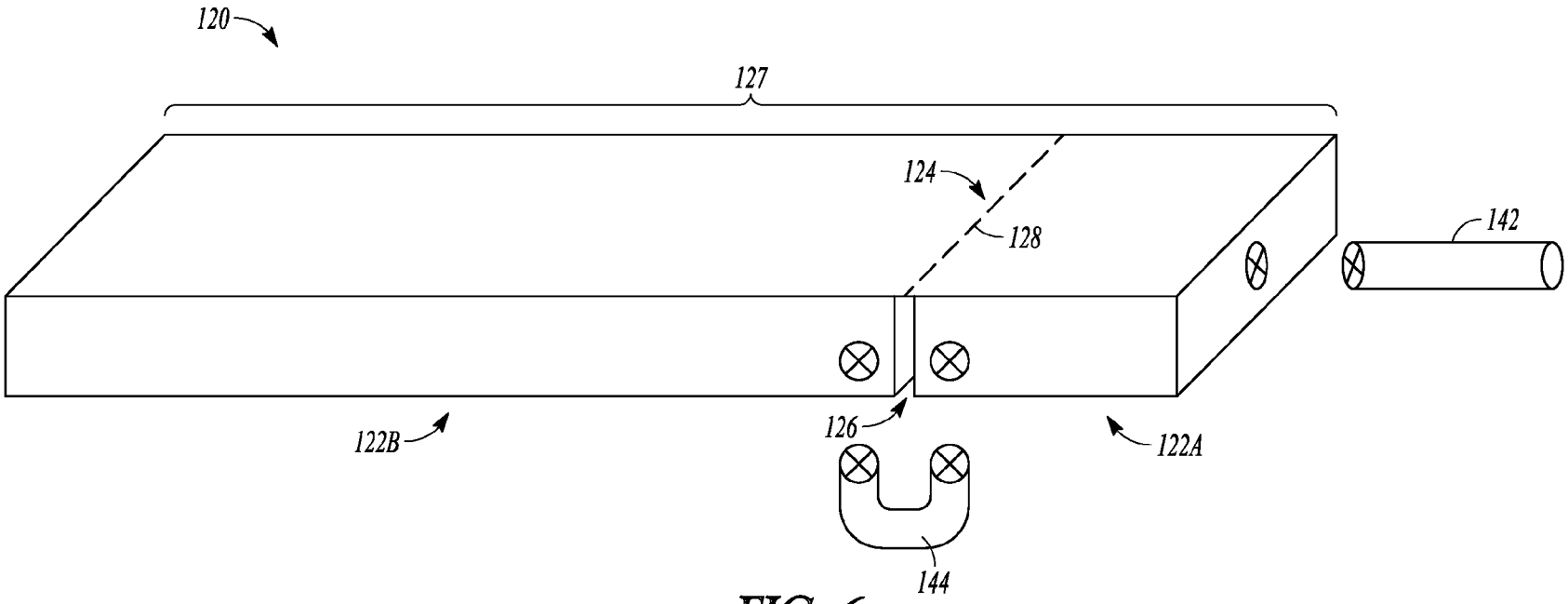
FIG. 6 is a conceptual perspective view of a second example of a support surface assembly.
Figure 15:
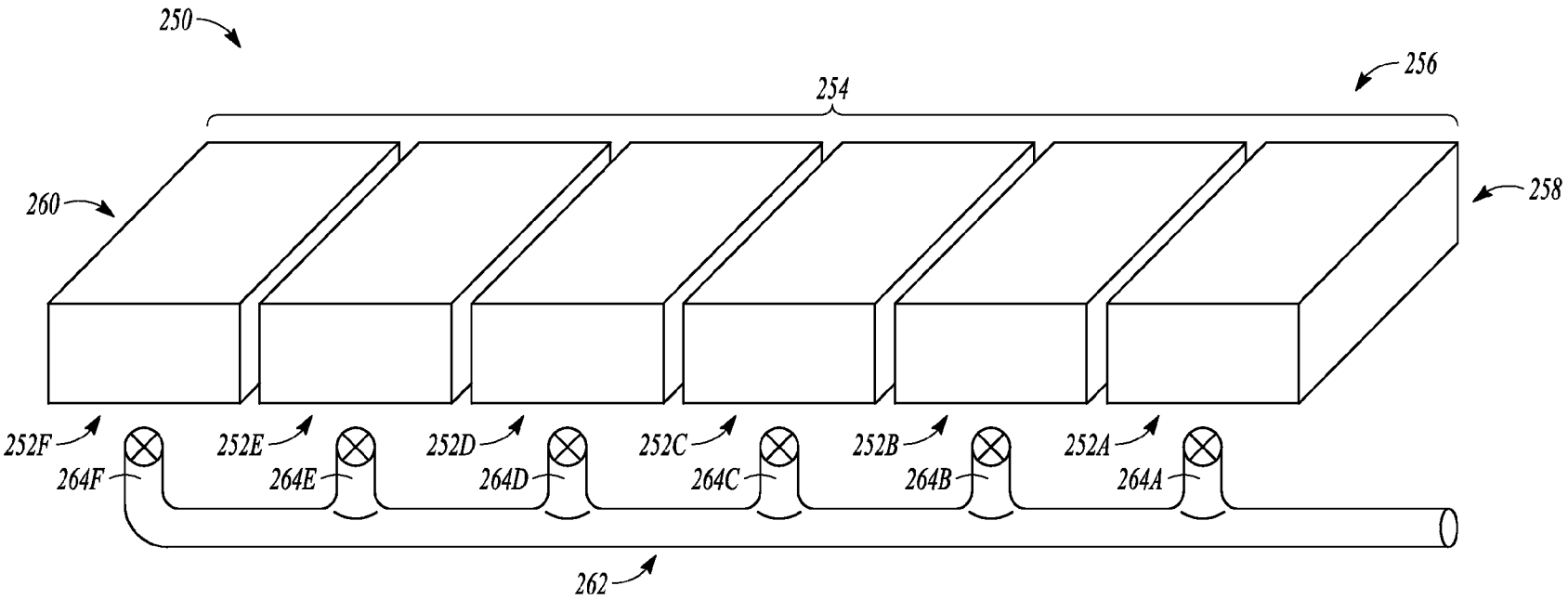
FIG. 15 is a conceptual perspective view of a ninth example of a support surface assembly.

FIGS. 2-4 show an example support surface assembly 60 that can be used in the example sleep system 10 of FIG. 1. For example, the support surface assembly 60 can form a part of either of the mattresses 18A, 18B of the bed 12. In an example, each sleep area 20, 22 can comprise a separate support surface assembly 60, and the pair of support surface assemblies 60 can be joined together to form a substantially uniform and substantially continuous support surface. An example of structures and methods for joining a pair of support surface assemblies 60 in a side-by-side arrangement is described in U.S. Pat. No. 7,865,988, issued on Jan. 11, 2011, assigned to the assignee of this application, the disclosure of which is incorporated by reference herein in its entirety The support surface assembly 60 can comprise a plurality of inflatable bladders 62A, 62B, 62C (collectively "inflatable bladder 62" or "inflatable bladders 62"), such as one or more fluid-inflatable bladders 62, for example one or more air-inflatable bladders 62. The inflatable bladders 62 can be arranged in a manner to form a support surface 64. The support surface 64 can be a sleep surface upon which an occupant 14, 16 can be supported, or the support surface 64 can support For example, a top surface 66A of a first inflatable bladder 62A, a top surface 66B of a second inflatable bladder 62B, and a top surface 66C of a third inflatable bladder 62C can be arranged in an end-to-end manner so as to form a continuous or substantially continuous support surface 64. In the example of FIGS. 2-4, the support surface assembly 60 includes three inflatable bladders 62A, 62B, 62C. However, the support surface assembly 60 can include fewer or more inflatable bladders 62. For example, as shown in FIGS. 5 and 6, a support surface assembly can include two inflatable bladders, or, as shown in FIG. 15, can include as many as six or more inflatable bladders.

Each inflatable bladder 62 can comprise a generally rectangular prism shape defined by a top wall 68A, 68B, 68C (collectively "top wall 68" or "top walls 68"), a bottom wall 70A, 70B, 70C (collectively "bottom wall 70" or "bottom walls 70"), side wall 72A, 72B, 72C (collectively "side wall 72" or "side walls 72") and side wall 74A, 74B, 74C (collectively "side wall 74" or "side walls 74"), and end wall 76A, 76B, 76C (collectively "end wall 76" or "end walls 76") and end wall 78A, 78B, 78C (collectively "end wall 78" or "end walls 78"). The inflatable bladders 62 can have substantially the same dimensions or can have different dimensions depending on the desired effect for the occupant 14, 16 lying on the support surface assembly 60.

As shown in FIG. 2, the inflatable bladders 62 can be arranged in a series end-to-end arrangement, e.g., with the second end wall 78A of the first inflatable bladder 62A being adjacent to the first end wall 76A of the second inflatable bladder 62B, and the second end wall 78B of the second inflatable bladder 62B being adjacent to the first end wall 76C of the third inflatable bladder 62C. In this way, the inflatable bladder 62 can be arranged in a head-to-toe fashion, e.g., with the first inflatable bladder 62A being adjacent to a head and upper torso of an occupant 14, 16, the second inflatable bladder 62B being adjacent to the trunk or lumbar area of an occupant 14, 16, and the third inflatable bladder 62C being adjacent to the legs of the occupant 14, 16.

Each inflatable bladder 62 can include one or more baffles 80 within the cavity of the inflatable bladder 62. Each baffle 80 can provide for structural support of the inflatable bladder 62 in which it is located. Each baffle 80 can also provide for a desired distribution of fluid within the inflatable bladder 62. As shown best in the cross-sectional view of FIG. 4, each baffle 80 can extend generally vertically between a corresponding top wall 68 and a corresponding bottom wall 70.

Each inflatable bladder 62 can include a plurality of baffles 80 generally equally spaced through the inflatable bladder 62. The example inflatable bladders 62 shown in FIG. 4 each include five baffles 80 generally equally longitudinally spaced (e.g., spaced in the direction of arrows 82 in FIGS. 3 and 4).

In the example shown in FIGS. 2-4, the support surface assembly 60 is configured so that each baffle 80 is arranged in a generally horizontal direction relative to the occupant 14, 16, e.g., in a generally lateral direction as demonstrated by the arrows 84 in FIG. 3. In an example, each inflatable bladder 62 can include only generally horizontal or lateral baffles 80, e.g., with substantially no longitudinal baffles. In such an example, the only generally longitudinally extending support members in each inflatable bladder 62 are the side walls 72, 74, while each inflatable bladder 62 includes more laterally extending support members in the form of the end walls 76, 78 and the only laterally-extending baffles 80. Having only laterally-extending baffles 80, versus both laterally-extending and longitudinally-extending baffles, can have advantages, such as improved support, a more stable or more even support surface for various occupant positions, such as when an occupant lies close to the edge of the bed or close to the middle of the bed (the edge of an inflatable bladder 62). This benefit can be observed in both articulable and non-articulable sleep systems, including when the sleep surface is flat or substantially flat. In another example, each inflatable bladder 62 can have its primary support provided by horizontal or laterally extending baffles 80, but can also include one or more longitudinal baffles 81 located proximate to a side wall 72, 72, e.g., at a distance from the side wall 72, 74 of within about 20% of the width of the inflatable bladder 62.

In an example, a thickness of each inflatable bladder 62, and any baffles between or adjacent to the inflatable bladders 62, can be from about 2.5 centimeters (cm) (about 1 inch) to about 25 cm (about 10 inches). The walls 68, 70, 72, 74, 76, 78 and baffles 80 of the inflatable bladders 62 can comprise any material that can be useful for an inflatable application, particularly with respect to fluid-inflatable bladders for sleep systems. Examples of materials that can be used for the inflatable bladders 62 include, but are not limited to, cotton rubber materials, nylon, polyvinylchloride, polyester, polyurethane, rayon vinyl, and combinations thereof.

FIGS. 5-15 show various examples of different features and configurations of support surface assemblies that can be used, for example, in the sleep system of FIG. 1. Each example support surface assembly includes two or more inflatable bladders, and each inflatable bladder in the examples of FIGS. 5-15 can include features of the inflatable bladders 62 described above with respect to the support surface assembly 60 in FIGS. 2-4.

FIG. 5 shows a conceptual perspective view of a first example support surface assembly 100. The example support surface assembly 100 includes two inflatable bladders 102A, 102B having different sizes. A first inflatable bladder 102A can be positioned generally at a head end of the support surface assembly 100 such that the first inflatable bladder 102A can support the head and upper torso of an occupant. The first inflatable bladder 102A is, therefore, referred to herein as a "head bladder 102A." The second inflatable bladder 102B can be positioned longitudinally adjacent to the head bladder 102A, e.g., at a foot end of the support surface assembly 100 such that the second inflatable bladder 102B can support the feet, legs, and lumbar region of an occupant. The second inflatable bladder 102B is, therefore, referred to herein as a "foot bladder 102B."

The head bladder 102A and the foot bladder 102B can be sized for a desired effect. In an example, the head bladder 102A can be sized so that at certain pressures, such as low pressures within the bladder 102A, the shifting of an occupant during sleep, or the shifting of the bladder 102A during articulation, will not substantially affect the overall pressure in the head bladder 102A. One factor that can determine the effect of shifting or articulation is the overall volume of the head bladder 102A, which can be changed by changing the overall length of the head bladder 102A.

In an example, the head bladder 102A and the foot bladder 102B are sized so that the space between the head bladder 102A and the foot bladder 102B, referred to herein as a break 104, is positioned adjacent to a joint between articulable sections of a bed frame, such as, for example, the joint 25 of the first head section 24 or the joint 29 of the second head section 28 on the bed 12 of FIG. 1. In an example, the head bladder 102A and the foot bladder 102B can be sized so that the break 104 is substantially aligned directly with the corresponding joint 25, 29.

As shown in the example of FIG. 5, the head bladder 102A and the foot bladder 102B can be completely separate inflatable bladders such that the adjacent bladders 102A, 102B are substantially free to move with respect to one another, for example substantial freedom to move in one or more of a longitudinal direction, in a lateral direction, and in a vertical direction. The substantially free movement of the head bladder 102A and the foot bladder 102B can allow for better positioning of the bladders 102A, 102B with respect to each other during movement of the bed or the occupant. The more free movement can provide for advantages such as better alignment of the occupants spine during sleep, particularly when the inflatable bladders 102A, 102B are inflated to higher pressures. The substantially free movement can also provide a more stable support surface, such as by dampening wave-like movement of the support surface assembly 100. The substantially free movement can also provide for more cost-effective replacement or easier replacement of inflatable bladders 102, or both. The substantially free inflatable bladders 102 can also have better aesthetics, e.g., can be more visually appealing.

In the example shown in FIG. 5, the head bladder 102A and the foot bladder 102B are discontinuous bladders 102A, 102B that are not connected together by a fastener or other fastening structure. However, the bladders 102A, 102B can, in theory, be connected by some kind of structure that is sufficiently long so that the structure does not substantially interfere with free movement of the head bladder 102A with respect to the foot bladder 102B, and vice versa. In such an arrangement, the inflatable bladders 102A, 102B can still be considered substantially free to move with respect to one another. In addition, the head bladder 102A and the foot bladder 102B can be encased in a cover, such as a cloth mattress cover (not shown) that can provide some restriction to the movement of the bladders 102A, 102B but does not substantially interfere with the free relative movement described above.

The bladders 102A, 102B can be inflatable and deflatable in order to control the pressure within the bladders 102A, 102B, and thus to control the perceived firmness of the support surface assembly 100 as experienced by an occupant. In the case of fluid-inflatable bladders 102A, 102B, a fluid inlet hose 106 can be connected to one of the inflatable bladders 102A, 102B. The fluid inlet hose 106 can be connected to an fluid filling source (not shown), such as an air pump for air inflatable bladders, that feeds pressurized fluid into the inflatable bladders 102A, 102B in order to inflate the inflatable bladders 102A, 102B and to provide the desired pressure, and therefore the desired firmness, for the occupant.

In an example, a valve 108 can be positioned either within the fluid inlet hose 106 or at a connection point for the fluid inlet hose 106 in order to control the flow of fluid through the fluid inlet hose 106 and into the inflatable bladders 102A, 102B. A corresponding bladder inlet valve 110 can be included on the head bladder 102A to prevent fluid from escaping the head bladder 102A if the fluid inlet hose 106 is disconnected from the head bladder 102A. In another example, the fluid inlet hose 106 can be coupled directly to the inflatable bladder 102.

As shown in the example of FIG. 5, the head bladder 102A and the foot bladder 102B are connected together in a series fluid communication arrangement. The term "series fluid communication," as used herein, can refer to a plurality of fluid bladders, wherein only one of the plurality of fluid bladders are connected to an fluid filing source, such as an air pump for air-inflatable bladders, and each subsequent fluid bladder is connected to the previous fluid bladder with a connecting conduit, e.g., so that the fluid filling source for each subsequent fluid bladder is via the connecting conduit rather than a direct connection to the fluid filling source. For example, as shown in FIG. 5, only the head bladder 102A is connected to a fluid filling source via the fluid inlet hose 106 and the foot bladder 102B is connected to the head bladder 102A via a connecting hose 112 that runs from the head bladder 102A across the break 104 to the foot bladder 102B. The only source of fluid into the foot bladder 102B is fluid from the head bladder 102A through the connecting hose 112.

The connecting hose 112 can include a first valve 114A on the head-bladder side of the connecting hose 112 and a second valve 114B on the foot-bladder side of the connecting hose 112. Each inflatable bladder 102A, 102B can include a corresponding bladder valve, such as a head-bladder outlet valve 116 and a foot-bladder inlet valve 118, which can be included to prevent fluid from escaping from the inflatable bladders 102A, 102B when the connecting hose 112 is disconnected. In another example, the connecting hose 112 can be coupled directly to the inflatable bladders 102A, 102B.

The series fluid connection between the head bladder 102A and the foot bladder 102B can provide a simpler design over parallel fluid connections, e.g., where the fluid filling source is connected directly to two or more of the fluid bladders, such as is shown in the examples of FIGS. 10, 12, 13, and 15.

Specifically, the occupant will only need to select a single pressure setting or firmness setting because the fluid filling source, e.g., an air pump for air-inflatable bladders, is only connected to the support surface assembly 100 at one point, to the head bladder 102A via the fluid inlet hose 106. The distribution of fluid between the head bladder 102A and the foot bladder 102B will occur naturally due to pressure differences between the inflatable bladders 102A, 102B as the inflatable bladders 102A, 102B are distorted by the occupant shifting position, such as when an occupant changes position during sleep (e.g., changes from side to back or from back to stomach, or vice versa) or when an occupant sits up on the bed, or articulation of the bed, or both. The series airflow connection can also allow the bed to auto-adjust to compensate for occupant shifting position, such as changing from a back position to a side position, without need to manual change the pressure setting.

FIG. 6 shows a conceptual perspective view of a second example support surface assembly 120. Like the example support surface assembly 100 of FIG. 5, the example support surface assembly 120 of FIG. 6 includes two inflatable bladders 122A, 122B having different sizes. The first inflatable bladder 122A can be positioned generally at a head end of the support surface assembly 120 and is, therefore, referred to herein as a "head bladder 122A." The second inflatable bladder 122B can be positioned longitudinally adjacent to the head bladder 122A, e.g., at a foot end of the support surface assembly 120 and is, therefore, referred to herein as a "foot bladder 122B."

The primary difference between the support surface assembly 100 of FIG. 5 and the support surface assembly 130 of FIG. 6 is that the inflatable bladders 122A, 122B in FIG. 6 are connected together at a flexible joint 124 located at a break 126 between the inflatable bladders 122A, 122B. In an example, the flexible joint 124 can be formed by a common sheet of material that spans across both the head bladder 122A and the foot bladder 122B. The flexible joint 124 can be on the top of the support surface assembly 120, e.g., so that the inflatable bladders 122A, 122B can pivot generally upward at the flexible joint 124, or the flexible joint 124 can be on the bottom of the support surface assembly 120, e.g., so that the inflatable bladders 122A, 122B can pivot generally downward at the flexible joint 124. The location of the flexible joint 124 can be selected to be on the top or on the bottom of the support surface assembly 120 depending on the desired ease of pivoting in a particular direction. For example, if the flexible joint 124 is to be located over an articulable joint in an articulable sleep system that articulates upward, such as the head section joints 25, 29 in the sleep system 10 of FIG. 1, than the flexible joint 124 can be located on the top of the support surface assembly 120, e.g., to better permit one of the inflatable bladders 122A, 122B to pivot upward relative to the other. Similarly, if the flexible joint 124 is to be located over an articulable joint that articulates downward, such as leg section joints 27, 31 in the sleep system 10 of FIG. 1, then the flexible joint 124 can be located on the bottom of the support surface assembly 120, e.g., to better permit one of the inflatable bladders 122A, 122B to pivot downward relative to the other.

The flexible joint 124 can limit the motion of the head bladder 122A with respect to the foot bladder 122B to a certain extent so that the inflatable bladders 122A, 122B are not substantially free to move with respect to one another, e.g., because the inflatable bladders 122A, 122B cannot substantially move longitudinally or laterally with respect to one another, but are free to pivot with respect to one another.

In an example, the flexible joint 124 can be formed in a support surface 127 that is formed by the support surface assembly 120. For example, the top walls (similar to the top walls 68 of the inflatable bladders 62 in FIGS. 2-4) of the head bladder 122A and the foot bladder 122B can both be formed by a continuous sheet of material that spans across the entire length of the support surface assembly 120. Alternatively, the continuous sheet of material can be coupled with the top wall of the head bladder 122A and the top wall of the foot bladder 122B. Such a continuous sheet of material can also be laid across the bottom walls of the inflatable bladders 122A, 122B to form the flexible joint 124 on a bottom side, rather than the top side of the support surface assembly 120.

Figure 7:
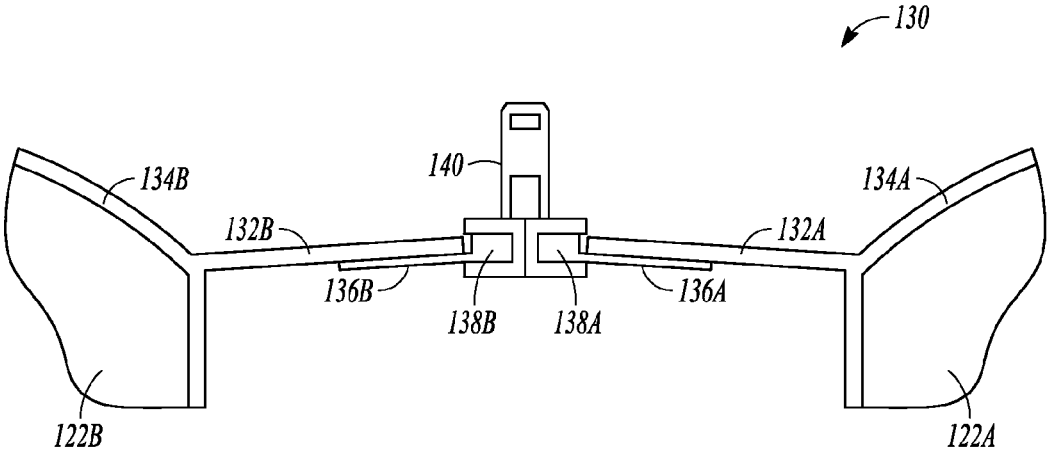
FIG. 7 is a side view of a flexible joint including a releaseable mechanical connection between a pair of inflatable bladders.

In an example, the flexible joint 124 can include one or more releasable fasteners 128 that can allow the inflatable bladders 122A, 122B to be disconnected and separated from one another if needed. For example, the releasable fastener 128 can comprise a zipper between the head bladder 122A and the foot bladder 122B. FIG. 7 shows a close-up view of an example zipper 130 that can be used to connect the head bladder 122A to the foot bladder 122B. The head bladder 122A can include a tongue 132A of material that extends from the head bladder 122A, for example as an extension of the top wall 134A of the head bladder 122A. The foot bladder 122B can include a corresponding tongue 132B of material that extends from foot bladder 122B, for example as an extension of the top wall 134B of the foot bladder 122B. A corresponding side of tape 136A, 136B of the zipper 130 can be coupled to each tongue 132A, 132B. A corresponding set of zipper teeth 138A, 138B are coupled to each side of the tape 136A, 136B, and the zipper teeth 138A, 138B can be coupled together by the slider 140 being pushed or pulled along the zipper 130. Releasable fasteners 128 other than a zipper can be used, such as releasable clips, releasable clamps, or releasable hooks and eyelets.

One or more releasable fasteners 128 coupling the inflatable bladders 122A, 122B can allow a damaged inflatable bladder to be uncoupled from an undamaged inflatable bladder to replace the damaged inflatable bladder without having to replace the entire support surface assembly, e.g., without having to replace the undamaged inflatable bladder. For example, if during use, the foot bladder 122B becomes damaged, such as by being punctured or developing a leak, while the head bladder 122A remains undamaged. The one or more releasable fasteners 128 can then be disengaged to uncouple the damaged foot bladder 122B from the undamaged head bladder 122A. The damaged foot bladder 122B can then be removed without having to replace the undamaged head bladder 122A. A replacement foot bladder 122B can then be coupled to the undamaged head bladder 122A with the one or more releasable fasteners 128.

The example support surface assembly 120 of FIG. 6 is otherwise substantially the same as the example support surface assembly 100 of FIG. 5. For example, the support surface assembly 120 also only comprises two inflatable bladders 122A, 122B with a head bladder 122A that is sized to be shorter in a longitudinal direction than the foot bladder 122B. The support surface assembly 120 is connected to a fluid filling source, such as an air pump for air inflatable bladders, via a fluid inlet tube 142. The inflatable bladders 122A, 122B are connected in a series fluid connection with a connecting hose 144.

Figure 8:
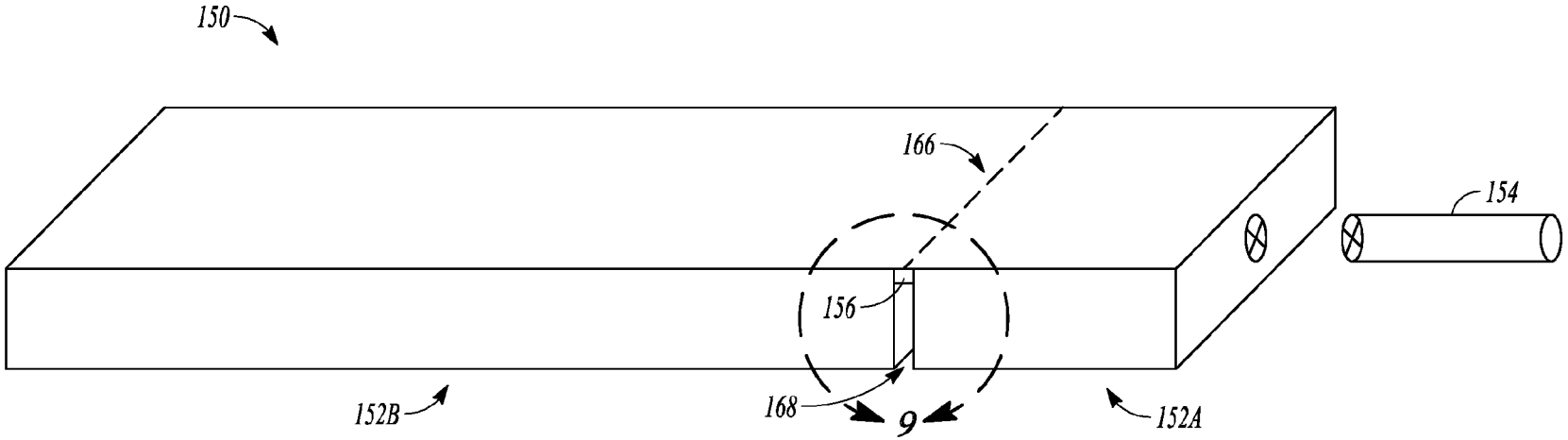
FIG. 8 is a conceptual perspective view of a third example of a support surface assembly.

FIG. 8 shows a conceptual perspective view of a third example support surface assembly 150. The example support surface assembly 150 is substantially similar to the example support surface assembly 120 of FIG. 6. Like the example support surface assembly 120 of FIG. 6, the example support surface assembly 150 of FIG. 8 includes two inflatable bladders 152A, 152B having different sizes. The first inflatable bladder 152A can be positioned generally at a head end of the support surface assembly 150 and is, therefore, referred to herein as a "head bladder 152A." The second inflatable bladder 152B can be positioned longitudinally adjacent to the head bladder 152A, e.g., at a foot end of the support surface assembly 150 and is, therefore, referred to herein as a "foot bladder 152B."

Also like the example support surface assembly 120 of FIG. 6, the example support surface assembly 150 can include a series fluid communication between the head bladder 152A and the foot bladder 152B, e.g., where only one of the inflatable bladders 152A, 152B is directly connected to an fluid filling source (such as the head bladder 152A being connected to an fluid inlet hose 154) and the two inflatable bladders 152A, 152B are connected together with a conduit that can allow fluid to flow between the inflatable bladders 152A, 152B.

In the example shown in FIG. 8, the series fluid communication comprises an integral conduit 156 formed between the head bladder 152A and the foot bladder 152B in place of the connecting hose 112, 144 used in the support surface assemblies 100, 120 of FIGS. 5 and 6. The integral conduit 156 can be formed as a passageway through a block of material that is integral with one or more walls of each of the inflatable bladders 152A, 152B. For example, the integral conduit 156 and one or more walls of each the inflatable bladders 152A, 152B can be molded or otherwise formed at the same time to form a single, integral piece. Alternatively, the integral conduit 156 can be formed separate from the inflatable bladders 152A, 152B, and can be aligned with corresponding openings in the inflatable bladders 152A, 152B and then coupled to the inflatable bladders 152A, 152B, such as via welding or with a sealing adhesive.

Figure 9:
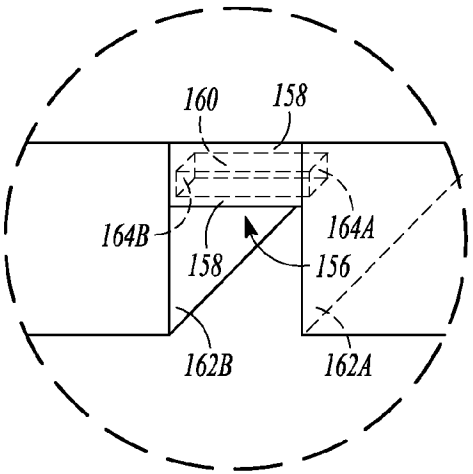
FIG. 9 shows a close-up cross-sectional view of an integral conduit between the inflatable bladders of the third example support surface assembly of FIG. 8.

FIG. 9 shows a cross-sectional view of the integral conduit 156 and its connection with the inflatable bladders 152A, 152B. As shown in FIG. 9, the integral conduit 156 can comprise one or more outer walls 158 surrounding a plenum 160. The integral conduit 156 can be coupled to an end wall 162A of the head bladder 152A and an end wall 162B of the foot bladder 152B such that the plenum 160 is substantially aligned with a hole 164A in the head bladder end wall 162A and a hole 164B in the foot bladder end wall 152B. The integral conduit 156 can also be adjacent to, and in some examples coupled to, a flexible joint 166 at the break 168 between the head bladder 152A and the foot bladder 152B. For example, if the flexible joint 166 comprises a cloth or plastic sheet of material that spans the break 168, the integral conduit 156 can be coupled to a bottom surface of the flexible joint 166.

Figure 10:
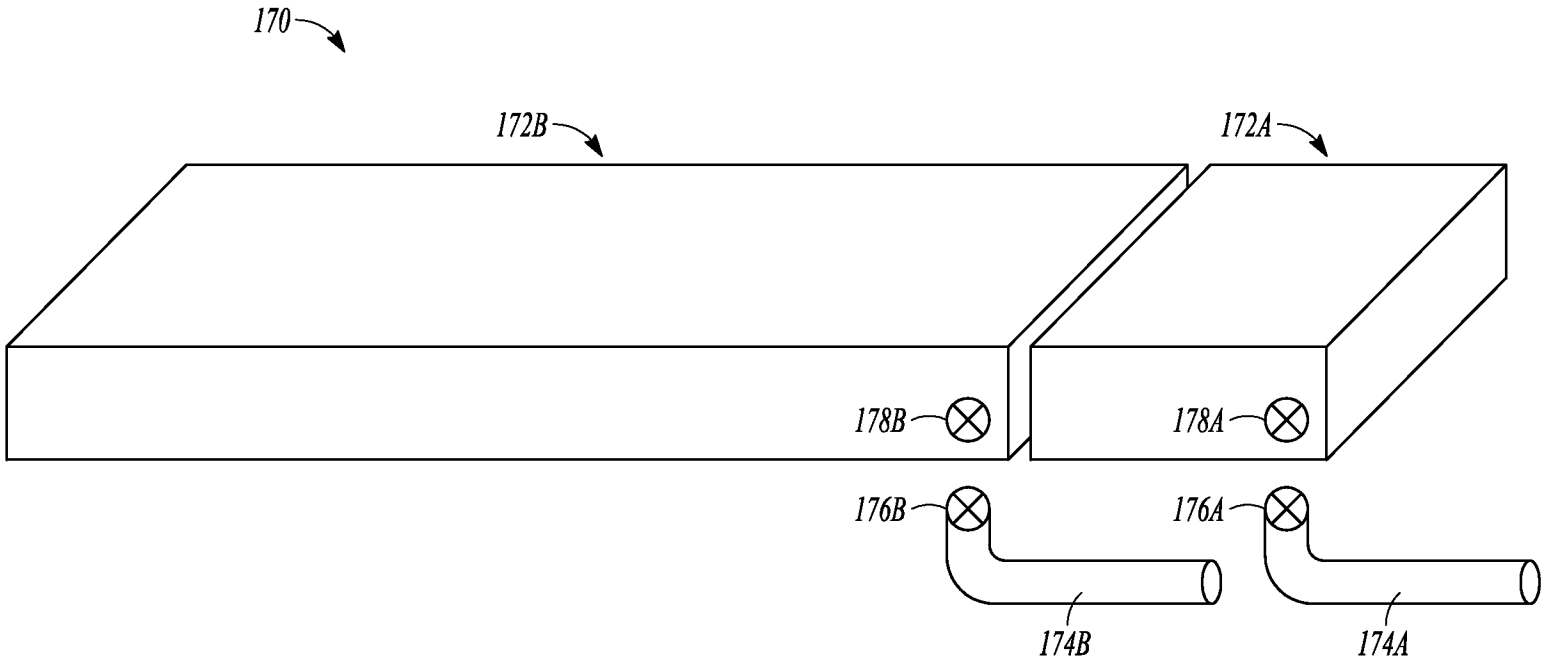
FIG. 10 is a conceptual perspective view of a fourth example of a support surface assembly.

FIG. 10 shows a conceptual perspective view of a fourth example support surface assembly 170. The example support surface assembly 170 is substantially similar to the example support surface assembly 100 of FIG. 5. Like the example support surface assembly 100, the example support surface assembly 170 of FIG. 10 includes two inflatable bladders 172A, 172B having different sizes. The first inflatable bladder 172A can be positioned generally at a head end of the support surface assembly 170 and is, therefore, referred to herein as a "head bladder 172A." The second inflatable bladder 172B can be positioned longitudinally adjacent to the head bladder 172A, e.g., at a foot end of the support surface assembly 170 and is, therefore, referred to herein as a "foot bladder 172B."

The primary different between the example support surface assembly 100 shown in FIG. 5 and the support surface assembly 170 of FIG. 10 is that the support surface assembly 170 comprises a parallel fluid communication to the inflatable bladders 172A, 172B rather than the series fluid communication shown in FIG. 5. The term "parallel fluid communication," as used herein, can refer to at least two inflatable bladders being directly connected to an fluid filling source, rather than a single fluid bladder being directly connected to the fluid filling source and subsequent inflatable bladders being connected to an adjacent inflatable bladder for its fluid filling source. For example, in the support surface assembly 170 of FIG. 10, both the head bladder 172A and the foot bladder 172B are connected to fluid inlet hoses 174A, 174B. The two fluid inlet hoses 174A, 174B can be connected to a fluid filling source, such as an air pump for air-inflatable bladders.

Each separate fluid inlet hose 174A, 174B can also be controlled separately in order to provide for independent control of the pressure, and thus the perceived firmness, of each inflatable bladder 172A, 172B. In an example, rather than providing for individual control of all the inflatable bladders 172A, 172B, the occupant can be allowed to set a pressure or perceived firmness of one of the inflatable bladders 172, such as the head bladder 172A, which in turn would set the pressure being applied by the filling source through the first inlet hose 174A. The system can then be configured to automatically set the pressure or perceived firmness in the foot bladder 172B to a preset pressure or perceived firmness relative to the selected pressure or firmness of the head bladder 172A. The system could be configured in reverse as well, with the occupant selecting the pressure or perceived firmness in the foot bladder 172B and the system automatically setting the pressure in the head bladder 172A based on the selected pressure or perceived firmness for the foot bladder 172B.

Each fluid inlet hose 174A, 174B can include a corresponding valve 176A, 176B to control or shut off fluid flow through the fluid inlet hoses 174A, 174B, and each inflatable bladder 172A, 172B can also include a corresponding bladder inlet valve 178A, 178B to prevent fluid from escaping an inflatable bladder 172A, 172B if a corresponding fluid inlet hose 174A, 174B is disconnected from the inflatable bladder 172A, 172B.

Like the support surface assembly 100 shown in FIG. 5, the example support surface assembly 170 of FIG. 10 includes inflatable bladders 172A, 172B that are substantially free to move with respect to one another, e.g., that are separate, discontinuous bladders 172A, 172B similar to bladders 102A, 102B as described above with respect to FIG. 5. However, the inflatable bladders 172A, 172B can be configured similar to the inflatable bladders 122A, 122B of the support surface assembly 120 of FIG. 6, e.g., with a flexible joint between the inflatable bladders 172A, 172B and with the flexibly joined inflatable bladders 172A, 172B having a parallel fluid communication arrangement.

FIGS. 5, 6, 8, and 10 each show various combinations of features that can be included in a support surface assembly having two inflatable bladders. The present disclosure is not limited to the specific embodiments shown or described with respect to these figures. Rather, a person of ordinary skill in the art can pick and choose the appropriate combination of features that will best achieve a desired result. For example, a person of ordinary skill can choose between discontinuous or otherwise substantially free to move inflatable bladders (as in FIGS. 5 and 10) and inflatable bladders joined by flexible joints (as in FIGS. 6 and 8) and can choose between a series fluid connection (as in FIGS. 5, 6, and 8) or a parallel fluid connection (as in FIG. 10).

Figure 11:
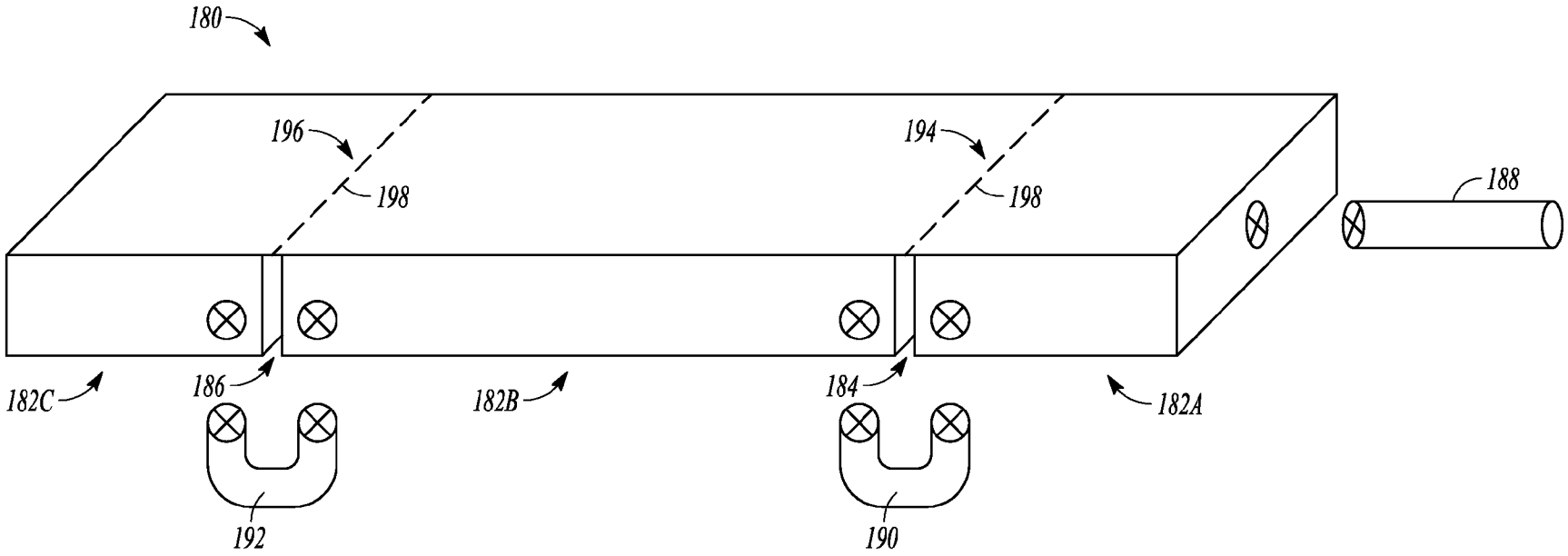
FIG. 11 is a conceptual perspective view of a fifth example of a support surface assembly.

FIG. 11 shows a conceptual perspective view of a fifth example support surface assembly 180. The example support surface assembly 180 includes three inflatable bladders 182A, 182B, 182C, rather than the two inflatable bladders shown in the example support surface assemblies 100, 120, 150, and 170 of FIGS. 5-10. A first inflatable bladder 182A can be positioned generally at a head end of the support surface assembly 180 such that the first inflatable bladder 182A can support the head and upper torso of an occupant. The first inflatable bladder 182A is, therefore, referred to herein as a "head bladder 182A." The second inflatable bladder 182B can be positioned longitudinally adjacent to the head bladder 182A and the third inflatable bladder 182C and can be sized so that the second inflatable bladder 182B can support the lumbar region, trunk/waist, and upper legs of an occupant. The second inflatable bladder 182B is, therefore, referred to herein as a "lumbar bladder 182B." The third inflatable bladder 182C can be positioned longitudinally adjacent to the lumbar bladder 182B so that the third inflatable bladder can support the lower legs and feet of an occupant. The third inflatable bladder 182C is, therefore, referred to herein as a "foot bladder 182C."

The head bladder 182A, lumbar bladder 182B, and the foot bladder 182C can be sized for a desired effect. In an example, the head bladder 182A can be sized so that at certain pressures, such as low pressures within the bladder 102A, the shifting of an occupant during sleep, or the shifting of the bladder 182A during articulation, will not substantially affect the overall pressure in the head bladder 182A. One factor that can determine the effect of shifting or articulation is the overall volume of the head bladder 182A, which can be changed by changing the overall length of the head bladder 182A.

In an example, the head bladder 182A, the lumbar bladder 182B, and the foot bladder 182C can be sized so that a break 184 between the head bladder 182A and the lumbar bladder 182B is positioned adjacent to a joint between articulable sections of a bed frame, such as, for example, the joint 25 of the first head section 24 or the joint 29 of the second head section 28 on the bed 12 of FIG. 1. Similarly, the head bladder 182A, the lumbar bladder 182B, and the foot bladder 182C can be sized so that a break 186 between the lumbar bladder 182B and the foot bladder 182C is positioned adjacent to a joint between articulable sections of a bed frame, such as, for example, the joint 27 of the first leg section 26 or the joint 31 of the second leg section 30 on the bed 12 of FIG. 1. In an example, the head bladder 182A, the foot bladder 182B, and the foot bladder 182C can be sized so that the break 104 is substantially aligned directly with the corresponding joint 25, 27, 29, 31.

Other than the number of inflatable bladders 182A, 182B, 182C, the support surface assembly 180 is similar to the support surface assembly 120 described above with respect to FIG. 6. Specifically, the support surface assembly 180 comprises a series fluid connection among the inflatable bladders 182A, 182B, 182C. An fluid filling source can be connected to only one of the inflatable bladders 182A, 182B, 182C, in this case the head bladder 182A via an fluid inlet hose 188. The support surface assembly 180 can also include a first connecting hose 190 connecting the head bladder 182A and the lumbar bladder 182B and a second connecting hose 192 connecting the lumbar bladder 182B and the foot bladder 182C.

The support surface assembly 180 can also include flexible joints between adjacent inflatable bladders 182A, 182B, 182C, similar to the flexible joint 124 of the support surface assembly 120 of FIG. 6. In the example shown in FIG. 11, the support surface assembly 180 can include a first flexible joint 194 connecting the head bladder 182A and the lumbar bladder 182B and a second flexible joint 196 connecting the lumbar bladder 182B and the foot bladder 182C. As with the flexible joint 124 in FIG. 6, each flexible joint 194, 196 can include a releasable fastener 198, such as a zipper, to allow a damaged inflatable bladder to be removed and replaced without having to replace undamaged inflatable bladders.

Figure 12:
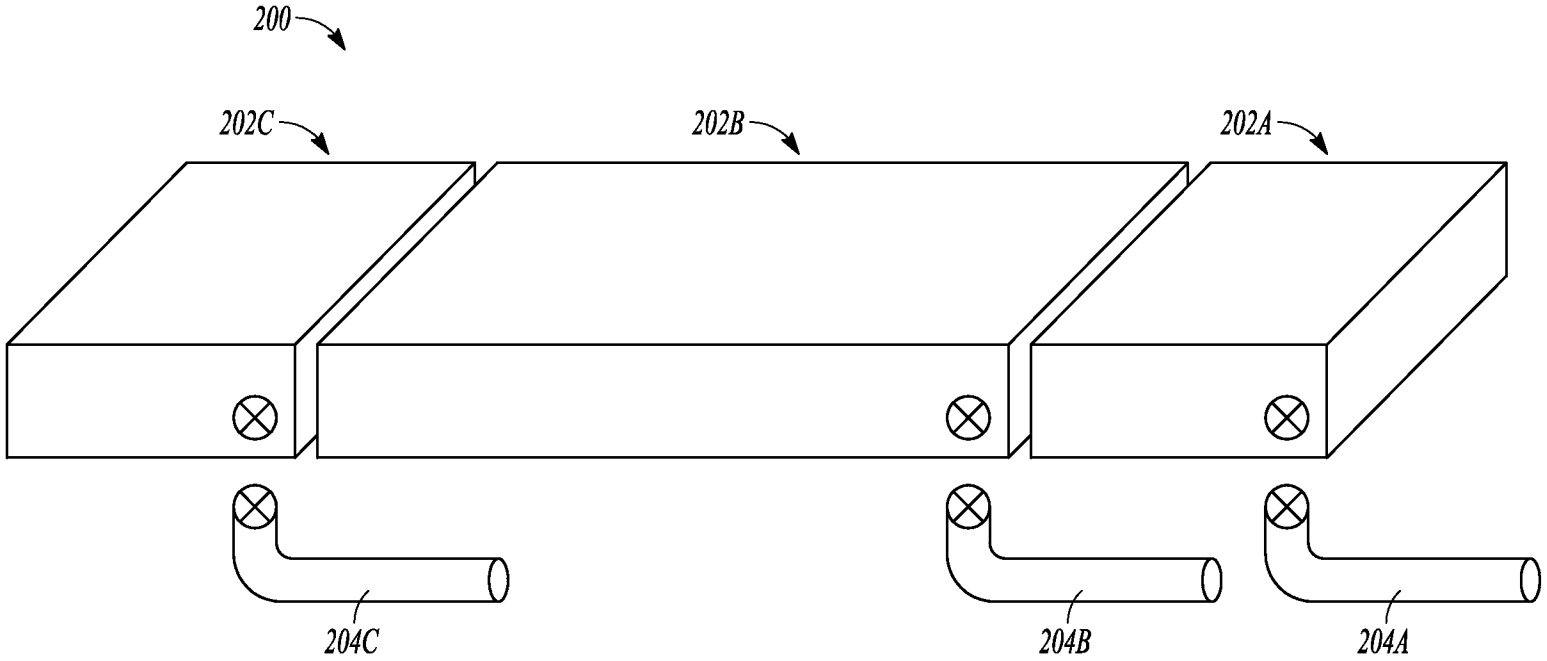
FIG. 12 is a conceptual perspective view of a sixth example of a support surface assembly.

FIG. 12 shows a conceptual perspective view of a sixth example support surface assembly 200. Like the example support surface assembly 180 of FIG. 11, the example support surface assembly 200 includes three inflatable bladders 202A, 202B, 202C. The first inflatable bladder 202A can be positioned generally at a head end of the support surface assembly 200 and is, therefore, referred to herein as a "head bladder 202A." The second inflatable bladder 202B can be positioned longitudinally adjacent to the head bladder 202A and in a middle position of the support surface assembly 200 to support a lumbar region of an occupant and is, therefore, referred to herein as a "lumbar bladder 202B." The third inflatable bladder 202C can be positioned longitudinally adjacent to the lumbar bladder 202B at a foot end of the support surface assembly 200 and is, therefore, referred to herein as a "foot bladder 202C."

The support surface assembly 200 of FIG. 12 is similar to the support surface assembly 170 of FIG. 10, with the only different being the number of inflatable bladders (e.g., two inflatable bladders 172A, 172B in FIG. 10 and three inflatable bladders 202A, 202B, 202C in FIG. 12). For example, the support surface assembly 200 can include inflatable bladders 202A, 202B, 202C that are substantially free to move with respect to one another, e.g., that are separate, discontinuous inflatable bladders 202A, 202B, 202C similar to the discontinuous bladders 172A, 172B of FIG. 10 and the bladders 102A, 102B of FIG. 5. The inflatable bladders 202A, 202B, 202C can also comprise a parallel fluid connection, e.g., with a first fluid inlet hose 204A connected to the head bladder 202A, a second fluid inlet hose 204B connected to the lumbar bladder 202B, and a third fluid inlet hose 204C connected to the foot bladder 202C. Each separate fluid inlet hose 204A, 204B, 204C can be controlled separately in order to provide for independent control of the pressure, and thus the perceived firmness, of each inflatable bladder 202A, 202B, 202C.

Figure 13:
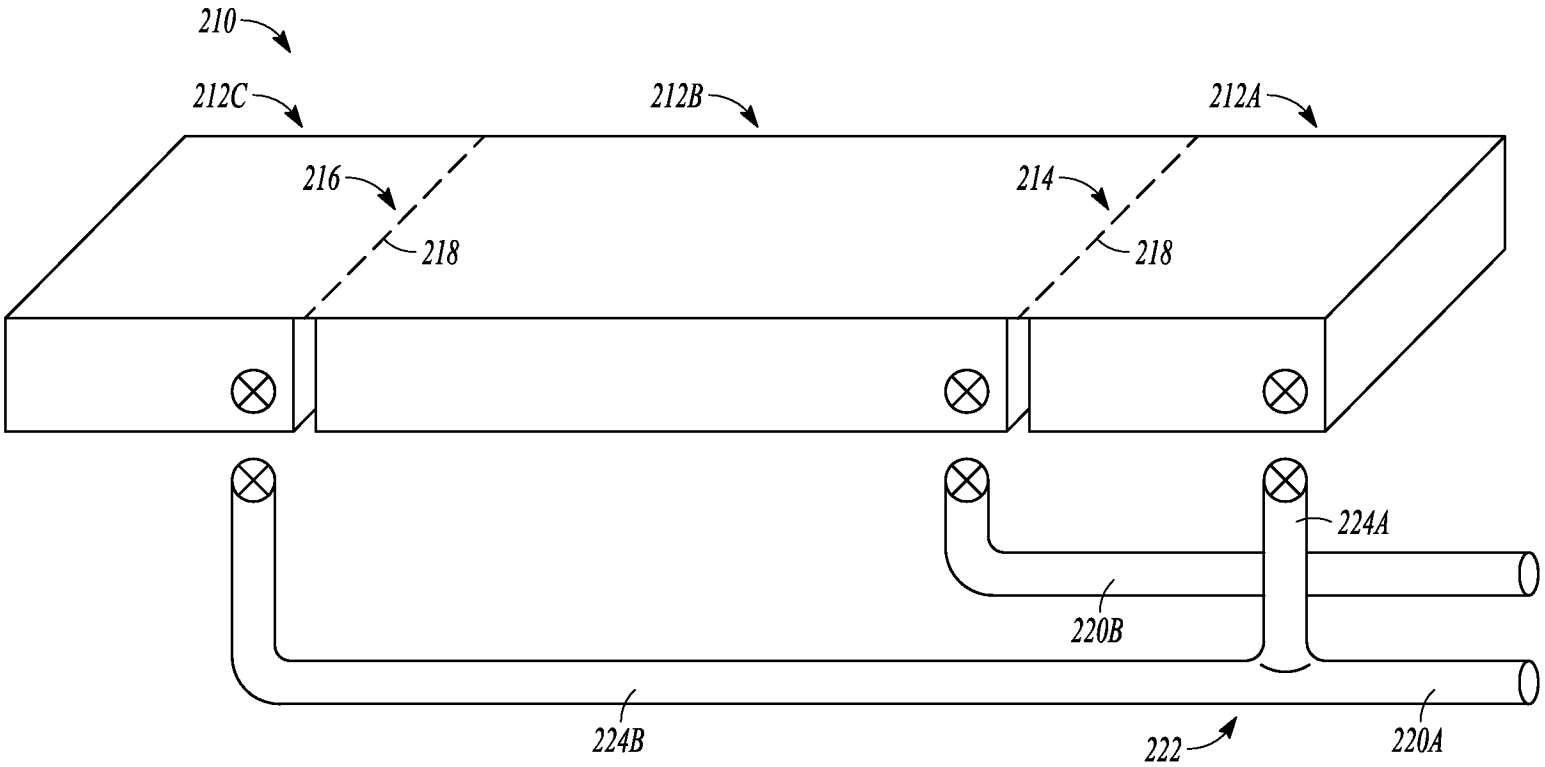
FIG. 13 is a conceptual perspective view of a seventh example of a support surface assembly.

FIG. 13 shows a conceptual perspective view of a seventh example support surface assembly 210. Like the example support surface assembly 200 of FIG. 12, the example support surface assembly 210 also includes three inflatable bladders 212A, 212B, 212C. The first inflatable bladder 212A can be positioned generally at a head end of the support surface assembly 210 and is, therefore, referred to herein as a "head bladder 212A." The second inflatable bladder 212B can be positioned longitudinally adjacent to the head bladder 212A and in a middle position of the support surface assembly 210 to support a lumbar region of an occupant and is, therefore, referred to herein as a "lumbar bladder 212B." The third inflatable bladder 212C can be positioned longitudinally adjacent to the lumbar bladder 212B at a foot end of the support surface assembly 210 and is, therefore, referred to herein as a "foot bladder 212C."

As shown in FIG. 13, the support surface assembly 210 can include a first flexible joint 214 between the head bladder 212A and the lumbar bladder 212B and a second flexible joint 216 between the lumbar bladder 212B and the foot bladder 212C. Each flexible 214, 216 can include a releasable fastener 218, such as a zipper, to allow a damaged inflatable bladder to be removed and replaced without having to replace undamaged inflatable bladders.

The support surface assembly 210 of FIG. 13 can include an fluid connection arrangement that is a parallel fluid connection, in that it includes at least two inflatable bladders that are connected directly to an fluid filling source, but the fluid connection arrangement is slightly different from the parallel fluid connection arrangement shown in FIG. 12 and other parallel fluid connections described above. Rather than each inflatable bladder 212A, 212B, 212C being directly connected to the fluid filling source and independently controlled, the support surface assembly 210 includes two of the three inflatable bladders 212A, 212B, 212C being connected together to the same fluid filling source, with the third inflatable bladder 212A, 212B, 212C being connected independent of the other two. In the example shown in FIG. 13, the head bladder 212A and the foot bladder 212C are both connected to a common first fluid inlet hose or manifold 220A that splits at a junction 222 into a first joint inlet 224A that is connected to the head bladder 212A and a second joint inlet 224B that is connected to the foot bladder 212C. A second fluid inlet hose 220B is connected to the lumbar bladder 212B. The arrangement of FIG. 13 allows for simplified control because an occupant only has to select two pressures or perceived firmnesses rather than three, as with the support surface assembly 200 of FIG. 12. The occupant need only select a pressure or firmness setting for the head bladder 212A and the foot bladder 212C combination and a separate pressure or firmness setting for the lumbar bladder 212B. The fluid connection arrangement of FIG. 13 is referred to herein as a "modified parallel fluid connection."

A modified parallel connection is not limited to the head bladder 212A and foot bladder 212C combination shown in FIG. 13. Rather, any combination of two of the bladders 212A, 212B, 212C can be connected together and the other bladder 212A, 212B, 212C being connected separately. Alternatively, all three bladders 212A, 212B, 212C can be connected together, such as to a common manifold tube that is connected to the filling source.

Figure 14:
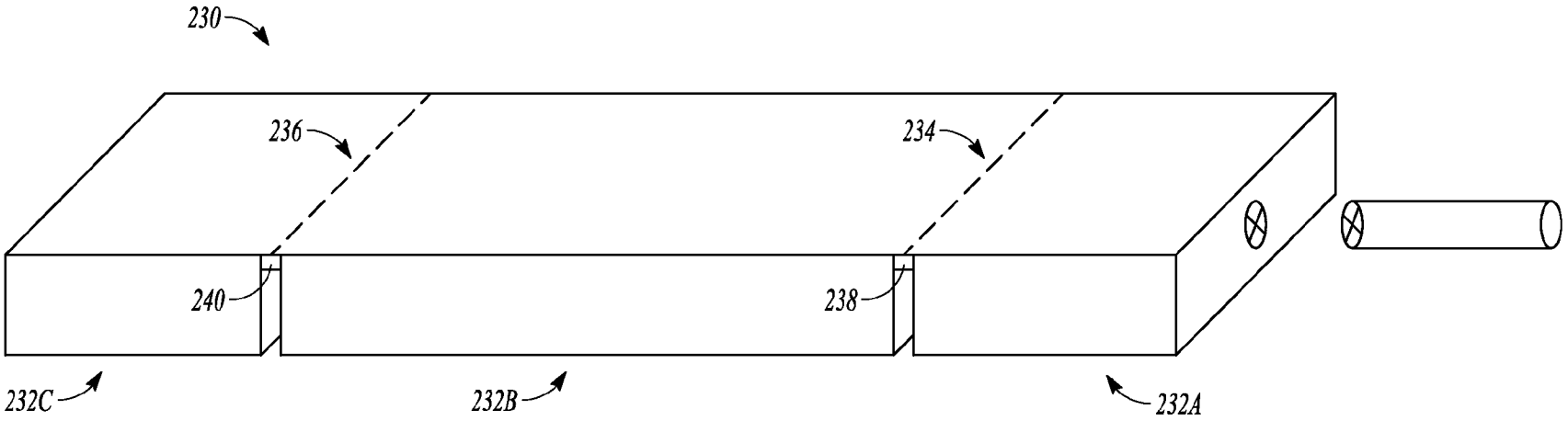
FIG. 14 is a conceptual perspective view of an eighth example of a support surface assembly.

FIG. 14 shows a conceptual perspective view of an eighth example support surface assembly 230 that is similar to the support surface assembly 150 shown in FIG. 8, but with three inflatable bladders 232A, 232B, 232C rather than the two inflatable bladders 152A, 152B shown in FIG. 8. The first inflatable bladder 232A can be positioned generally at a head end of the support surface assembly 230 and is, therefore, referred to herein as a "head bladder 232A." The second inflatable bladder 232B can be positioned longitudinally adjacent to the head bladder 232A and in a middle position of the support surface assembly 230 to support a lumbar region of an occupant and is, therefore, referred to herein as a "lumbar bladder 232B." The third inflatable bladder 232C can be positioned longitudinally adjacent to the lumbar bladder 232B at a foot end of the support surface assembly 230 and is, therefore, referred to herein as a "foot bladder 232C."

The support surface assembly 230 of FIG. 14 is substantially similar to the support surface assembly 180 of FIG. 11, in that it includes flexible joints 234, 236 between adjacent inflatable bladders 232A, 232B, 232C and includes a series fluid connection, with the only substantial difference being that the series fluid communication comprises integral conduits 238, 240 formed between the inflatable bladders 232A, 232B, 232C in place of the connecting hoses 190, 192 used in the support surface assembly 180 of FIG. 11. A first integral conduit 238 can be formed between the head bladder 232A and the lumbar bladder 232B, and a second integral conduit 240 can be formed between the lumbar bladder 232B and the foot bladder 232C. Each integral conduit 238, 240 can be similar to the integral conduit 156 described above with respect to FIGS. 8 and 9.

FIGS. 11, 12, 13, and 14 each show various combinations of features that can be implemented in a support surface assembly having three inflatable bladders. The present disclosure is not limited to the specific embodiments shown or described with respect to these figures. Rather, a person of ordinary skill in the art can pick and choose the appropriate combination of features that will best achieve a desired result. For example, a person of ordinary skill can choose between discontinuous or otherwise substantially free to move inflatable bladders (as in FIG. 12) and inflatable bladders joined by flexible joints (as in FIGS. 11, 13, and 14) and can choose between a series fluid connection (as in FIG. 11), a parallel fluid connection (as in FIG. 12), or a modified parallel fluid connection (as in FIG. 13).

FIG. 15 shows a conceptual perspective view of a ninth example support surface assembly 250. Like the previous support surface assemblies described above, the support surface assembly 250 of FIG. 15 includes a plurality of inflatable bladders 252A, 252B, 252C, 252D, 252E, 252F (collectively referred to herein as "inflatable bladder 252" or "inflatable bladders 252"). The inflatable bladders 252 form a sleep surface 254 on top of the support surface assembly 250. The inflatable bladders 252 are arranged in series in an array 256 from a head end 258 of the support surface 254 to a foot end 260 of the support surface 254. The term "arranged in series in an array" or "an array arranged in series," as used herein, can refer to the inflatable bladders 252 forming a continuous or semi-continuous support surface 254 of several relatively small inflatable bladders 252 that each form a relatively small percentage of the support surface 254, as compared to the inflatable bladders 102, 122, 152, 172, 182, 202, 212, and 232 described above with respect to FIGS. 5-14. For example, the inflatable bladders of FIGS. 5-14 each include at least one of the inflatable bladders forming a substantial percentage of their respective support surfaces, such as at least about 30% of the length of the support surface to at least about 50% of the length of the support surface, or more. In contrast, all of the inflatables bladder 252 of the array 256 in FIG. 15 each take up 25% or less of the length of the support surface, such as 20% or less of the length of the support surface, for example about 16.67% or less of the length of the support surface, about 15% or less of the length of the support surface, about 14.29% or less of the length of the support surface, about 12.5% or less of the length of the support surface, about 11.1% or less of the length of the support surface, about 10% or less of the length of the support surface, about 9.1% or less of the length of the support surface, about 8.33% or less of the length of the support surface, about 7.7% or less of the length of the support surface, about 7.1% or less of the length of the support surface, about 6.67% or less of the length of the support surface, about 6.25% or less of the length of the support surface, about 5.8% or less of the length of the support surface, about 5.55% or less of the length of the support surface, about 5.26% or less of the length of the support surface, or about 5% or less of the length of the support surface.

The relatively small inflatable bladders 252 of the array 256 in FIG. 15 can provide for more freedom to control the overall operation of the support surface assembly 250 compared to the relatively larger inflatable bladders 102, 122, 152, 172, 182, 202, 212, and 232 of FIGS. 5-14. In particular, the relatively smaller-sized inflatable bladders 252 can provide for more optimized response to an occupant's shifting while sleeping (e.g., less variation on the pressure or perceived firmness of the support surface assembly 250). The relatively smaller-sized inflatable bladders 252 can also provide for more optimized response to articulation of the bed, e.g., as described above with respect to the sleep system 10 of FIG. 1. The relatively smaller-sized inflatable bladders 252 can also provide for better control over the location of breaks between inflatable bladders 252, which can allow for more precise placement of the breaks, such as to provide better support or spinal alignment for the occupant or to better align the breaks with joints in an articulable bed frame. The relatively smaller-sized inflatable bladders 252 can also provide for a "higher resolution" for the positioning of the supports of the inflatable bladders 252 to provide more control for where a particular support point or points will be located for the occupant. The higher resolution can also allow the occupant greater control over their own comfort by providing more positions on his or her body that can have the pressure or perceived firmness adjusted, if the support surface assembly 250 comprises independent control of the pressure or perceived firmness in each inflatable bladder 252.

The support surface assembly 250 is shown as comprising a parallel fluid connection. As noted above, a parallel fluid connection can include two or more, and in some examples all of the inflatable bladders 252 being connected to an fluid filling source, such as an air pump for air inflatable bladders, such as via a plurality of fluid inlet hoses 264A, 264B, 264C, 264D, 264E, 264F (collectively "fluid inlet hose 264" or "fluid inlet hoses 264"), with each fluid inlet hose 264 being connected to a corresponding inflatable bladder 252. In the example shown in FIG. 15, a common manifold tube 262 can be connected to the fluid filling source, and the manifold tube 262 can split into the fluid inlet hoses 264A, 264B, 264C, 264D, 264E, 264F fed into each of the inflatable bladders 252A, 252B, 252C, 252D, 252E, 252F. In an example, the flow or fluid through each fluid inlet hose 264 can be controlled in order to control the pressure supplied to each inflatable bladder 252 or to control the perceived firmness of each inflatable bladder 252. The fluid connection arrangement of the support surface assembly 250 can also be a series fluid connection, similar to FIG. 11, or a modified parallel fluid connection, similar to that shown in FIG. 13. The fluid connection arrangement could also comprise a combination of two or more of a series fluid connection, a parallel fluid connection, or a modified parallel fluid connection, e.g., with a first set of the inflatable bladders 252 having a first type of fluid connection arrangement, such as a series fluid connection, and a second set of the inflatable bladders 252 having a second fluid connection arrangement, such as a parallel fluid connection.

In an example, each inflatable bladder 252 of the array 256 has substantially the same dimensions such that the array 256 is an array of substantially identical inflatable bladders 252 arranged in a series or end-to-end arrangement. The use of inflatable bladders 252 with substantially the same dimensions can allow for easy removal of inflatable bladders 252 (e.g., to modify the size of the support surface 254 provided by the support surface assembly 250), or to remove and replace damaged inflatable bladders 252, e.g., if the inflatable bladders 252 are either discontinuous and separate inflatable bladders 252, as shown in FIG. 15, or if the inflatable bladders 252 are connected by one or more releasable fasteners, such as the releasable fasteners described above.

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented, at least in part. Some examples can include a computer-readable medium or machine-readable medium encoded with instructions operable to configure an electronic device to perform methods or method steps as described in the above examples. An implementation of such methods or method steps can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The Abstract is provided to comply with 37 C.F.R. §1.72 (b), to allow the reader to quickly ascertain the nature of the technical disclosure. It is submitted with the understanding that it will not be used to interpret or limit the scope or meaning of the claims.

Although the invention has been described with reference to exemplary embodiments, workers skilled in the art will recognize that changes may be made in form and detail without departing from the spirit and scope of the invention.

What is claimed is:

1. A support surface assembly comprising:

a support surface;

a multi-zone chamber including a first inflatable bladder and a second inflatable bladder;

a fluid inlet tube configured to be connected to the first inflatable bladder; and a fluid communication conduit configured to extend between the first and second inflatable bladders and couple the first and second inflatable bladders in series fluid communication, wherein the fluid communication conduit is positioned between the first inflatable bladder and the second inflatable bladder and adjacent to the support surface such that the first inflatable bladder, the second inflatable bladder, and the fluid communication conduit at least partially define the support surface.

2. The support surface assembly of claim 1, wherein the first bladder and the second bladder are substantially free to move with respect to one another.

3. The support surface assembly of claim 1, wherein the first and second inflatable bladders are sized and shaped according to anatomical or anthropometric body regions of a user.

4. The support surface assembly of claim 3, wherein one of the first or second bladders is sized according to one or more of a head or feet of the user.

5. The support surface assembly of claim 1, wherein the support surface is configured for articulation between the first bladder and the second bladder.

6. The support surface assembly of claim 1, further comprising a flexible joint between the first inflatable bladder and the second inflatable bladder, the flexible joint comprising one or more releasable fasteners connecting the first inflatable bladder and the second inflatable bladder.

7. The support surface assembly of claim 6, wherein the flexible joint is in the support surface.

8. The support surface assembly of claim 1, wherein the support surface includes upper surfaces of the first and second inflatable bladders.

9. The support surface assembly of claim 1, wherein the fluid communication conduit between the first and second inflatable bladders comprises an integral conduit.

10. The support surface assembly of claim 9, wherein at least one valve is interposed between the first and second inflatable bladders in the fluid communication conduit.

11. The support surface assembly of claim 1, wherein the multi-zone chamber further comprises a third inflatable bladder, wherein the third inflatable bladder at least partially defines the support surface, the support surface assembly further comprising a second fluid communication conduit configured to extend between the second and third inflatable bladders and couple the second and third inflatable bladders in series fluid communication, wherein the second fluid communication conduit is positioned between the first inflatable bladder and the second inflatable bladder and at least partially defines the support surface.

12. The support surface assembly of claim 11, wherein the second fluid communication conduit between the second and third inflatable bladders comprises an integral conduit.

13. The support surface assembly of claim 12, wherein at least one valve is interposed between the second and third inflatable bladders in the second fluid communication conduit.

14. The support surface assembly of claim 1, wherein the fluid communication conduit is integrated into the support surface.

15. The support surface assembly of claim 1 further comprising a continuous sheet of material that at least partially defines an upper portion of the first inflatable bladder, an upper portion of the second inflatable bladder, and an upper portion of the fluid communication conduit.

16. The support surface assembly of claim 1, wherein the fluid communication conduit comprises a passageway through a portion of material that is integral with one or more walls of each of the first and second inflatable bladders.

17. The support surface assembly of claim 1, wherein at least a portion of the fluid communication conduit and at least a portion of the first inflatable bladder form a single integral piece.

18. The support surface assembly of claim 17, wherein at least a portion of the second inflatable bladder forms the single integral piece.

19. The support surface assembly of claim 1, further comprising:

an additional support surface positioned adjacent to the support surface;

an additional multi-zone chamber including a third inflatable bladder and a fourth inflatable bladder, the third and fourth inflatable bladders forming the additional support surface;

an additional fluid inlet tube configured to be connected to the third inflatable bladder to supply fluid to the third inflatable bladder from the fluid pump; and an additional fluid communication conduit configured to extend between the third and fourth inflatable bladders and couple the third and fourth inflatable bladders in series fluid communication;

wherein the support surface and the additional support surface are integrated into a single mattress.

20. A support surface assembly comprising:

a support surface;

a multi-zone chamber including a first inflatable bladder and a second inflatable bladder;

a fluid inlet tube configured to be connected to the first inflatable bladder;

a fluid communication conduit configured to extend between the first and second inflatable bladders and couple the first and second inflatable bladders in series fluid communication, wherein the fluid communication conduit is positioned between the first inflatable bladder and the second inflatable bladder; and a continuous sheet of material that at least partially defines an upper portion of the first inflatable bladder, an upper portion of the second inflatable bladder, and an upper portion of the fluid communication conduit.

21. The support surface assembly of claim 20, wherein the fluid communication conduit is integrated into the support surface.

22. The support surface assembly of claim 20, wherein the fluid communication conduit comprises a passageway through a portion of material that is integral with one or more walls of each of the first and second inflatable bladders.

23. The support surface assembly of claim 20, wherein at least a portion of the fluid communication conduit and at least a portion of the first inflatable bladder form a single integral piece.

24. The support surface assembly of claim 23, wherein at least a portion of the second inflatable bladder forms the single integral piece.

* * * * *

UNITED STATES PATENT AND TRADEMARK OFFICE

CERTIFICATE OF CORRECTION

PATENT NO. : 8,966,689 B2
APPLICATION NO. : 13/828985
DATED : March 3, 2015
INVENTOR(S) : John McGuire et al.

It is certified that error appears in the above-identified patent and that said Letters Patent is hereby corrected as shown below:

On the Title Page, Item (73) (Assignee), line 1, after "Select Comfort Corporation" insert -- (US) --.

Signed and Sealed this
Thirtieth Day of June, 2015

Michelle K. Lee

Michelle K. Lee
*Director of the United States Patent and Trademark Office*